US005618169A

United States Patent [19]

Smith

[11] Patent Number: 5,618,169

[45] Date of Patent: Apr. 8, 1997

[54] WATER WELL PUMP CYLINDER COMPONENTS

[76] Inventor: Loren E. Smith, Box 277, Higgins, Tex. 79046

[21] Appl. No.: 615,550

[22] Filed: Mar. 11, 1996

[51] Int. Cl.[6] ..... F04B 47/12; F04B 53/14

[52] U.S. Cl. ..... 417/554; 417/555.1; 417/555.2; 92/242

[58] Field of Search ..... 417/545, 554, 417/555.1, 555.2; 92/242

[56] References Cited

U.S. PATENT DOCUMENTS

| | | | |
|---|---|---|---|
| 430,919 | 6/1890 | Campbell | 417/448 |
| 1,039,496 | 8/1912 | Daniels | 417/448 |
| 1,497,541 | 6/1924 | Camblin | 417/554 |
| 2,065,051 | 12/1936 | Carr et al. | 417/554 |
| 2,074,591 | 3/1937 | Rood | 417/554 |
| 2,236,210 | 3/1941 | Foggan | 417/554 |
| 2,527,929 | 10/1950 | Hebard | 417/554 |
| 2,583,111 | 1/1952 | Mardis | 417/554 |
| 2,633,808 | 4/1953 | Webber | 417/554 |
| 3,075,474 | 1/1963 | Kelley | 417/554 |

*Primary Examiner*—Timothy Thorpe
*Assistant Examiner*—William Wicker
*Attorney, Agent, or Firm*—Robert K. Rhea

[57] ABSTRACT

Water well pump plunger efficiency is improved by providing a pair of upwardly open outwardly flared wall cups surrounding a pump plunger and supported in superposed relation by a sleeve in the lowermost cup. A fluid passageway through the base of the uppermost cup insures filling the lowermost cup on the plunger upstroke.

8 Claims, 2 Drawing Sheets

WATER WELL PUMP CYLINDER COMPONENTS

BACKGROUND OF THE INVENTION

The present invention relates to water wells and more particularly to improvements in pump components.

1. Field of the Invention

Water well pumping apparatus usually comprises a pump cylinder lowered into a well bore on the depending end of a tubing string. The cylinder having means at its lowermost end for supporting a check valve generally referred to as a standing valve. A gas anchor, such as a length of perforated screened pipe, may depend axially from the cylinder, if desired. A string of sucker rods are installed in the tubing, and supports at its lowermost end, a hollow plunger having a top end traveling valve, within the cylinder. The plunger has an annular seal or seals which contacts the inner periphery of the cylinder for progressively lifting fluid to exit the surface of the earth at the upper limit of the tubing string by the vertical reciprocating action of the sucker rods by a suitable mechanism at the surface of the earth. Up stroke of the sucker rods reduces the pressure in the cylinder below the plunger to open the standing valve and draw water into the depending end portion of the cylinder. Downward movement of the sucker rods and plunger closes the standing valve and opens the traveling valve for moving water through the plunger into the cylinder above the position of the annular seal or seals. Subsequent upward movement of the sucker rods closes the plunger top valve by gravity and the static head and lifts the water above the plunger seals toward the surface of the earth while simultaneously repeating the opening of the standing valve and filling the depending end of the cylinder.

The above described water well pumping apparatus is improved by this invention by providing an improved type plunger cup which by its manner of construction improves its seal with the inner periphery of the cylinder by the static head and has a long useful life and further provides an improved standing valve seating and retrieval device.

2. Description of the Prior Art

U.S. Pat. No. 430,919 issued Jun. 24, 1890 to Campbell, et al for oil pump, and U.S. Pat. No. 1,039,496 issued Sep. 24, 1912 to Daniels, et al for expanding sleeve for standing valve are considered good examples of the state-of-the-art. The Campbell et al patent discloses a series of cup shaped seals around the centrally bored plunger sealing with the wall of a working barrel, and a standing valve which is tethered to the plunger for removal therewith as a unit.

The Daniels, et al patent discloses a plunger seal of the cylindrical type and a standing valve also tethered to the plunger.

This invention is believed distinctive over these and other similar patents by providing a plurality of cup-like seals on a pump plunger in which the outwardly flared upwardly tapering wall of the cup seal is biased outward into engagement with the inner periphery of the surrounding cylinder by the static head of fluid and upward movement of the plunger. Further, this invention provides a frangible coupler between the depending end of the plunger and the standing valve which is shattered at the time of installation of the standing valve in the depending end of the working cylinder.

SUMMARY OF THE INVENTION

An elongated hollow sucker rod reciprocated plunger, dimensioned to be cooperatively received by the bore of a conventional working barrel or cylinder, is provided with a top traveling valve and cage and at least two superposed peripheral cup seals. A longitudinal planar surface subtends an arc of the plunger periphery and extends across the top cup base to fill the bottom cup with fluid before and during upward movement of the plunger relative to the cylinder to insure a fluid tight seal of both upper and lower cup walls with the inner periphery of the cylinder.

A standing valve, adapted for seating on an annular inner shoulder at the depending end of the cylinder, is removably connected with the depending end of the plunger by a biodegradable frangible coupler. The coupler is shattered by striking the uppermost end of the sucker rod string when the standing valve is initially contacting the annular shoulder which releases the plunger from the standing valve while simultaneously seating it on the annular shoulder.

The principal objects of this invention are to provide a plurality of superposed cups surrounding the plunger in a water well pump cylinder to insure both cups being filled with water on the upstroke of the plunger for biasing the cup walls outwardly in intimate contact with the cylinder inner wall surface for moving all water above the position of the cups upwardly on each upstroke of the plunger; to provide a standing valve with an upwardly open cup which maintains a seal with the cylinder wall by the static head: and, to provide a biodegradable coupler separably joining the plunger to the standing valve for seating the latter on a standing valve seat.

DESCRIPTION OF THE PREFERRED EMBODIMENTS

Figure 1:
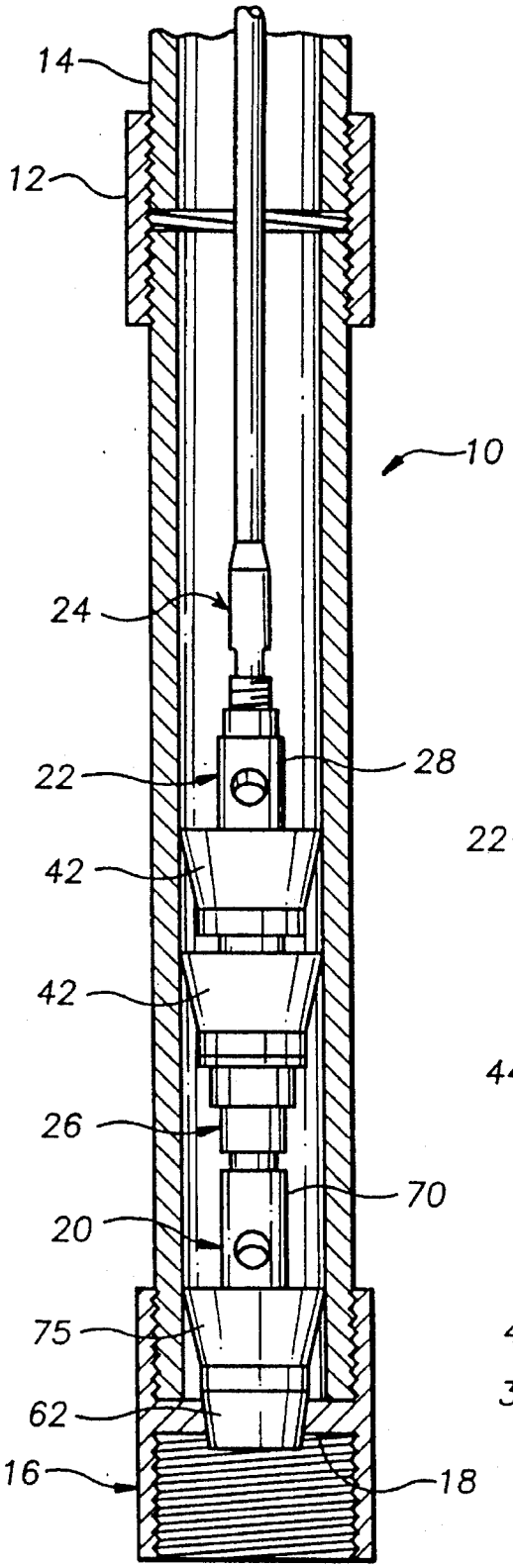
FIG. 1 is a fragmentary vertical cross sectional view of a pump cylinder containing the improved plunger, cups and standing valve, the plunger being connected with the depending end of a sucker rod string.

Like characters of reference designate like parts in those figures of the drawings in which they occur.

In the drawings:

The reference numeral 10 indicates a conventional water well cylinder connected by a coupling 12 to the depending end portion of a tubing string 14 within a casing equipped well bore, not shown. The cylinder has a standing valve coupling 16 at its depending end including an internal annular shoulder 18 for supporting and sealing with a standing valve assembly 20 as hereinafter described.

A plunger assembly 22, connected with the depending end portion of a sucker rod string 24, is initially connected to the standing valve assembly 20 by a frangible element 26 comprising a frangible pin and box coupler, preferably formed from biodegradable material, for seating the standing valve and separating the plunger therefrom, as presently described.

Figure 2:
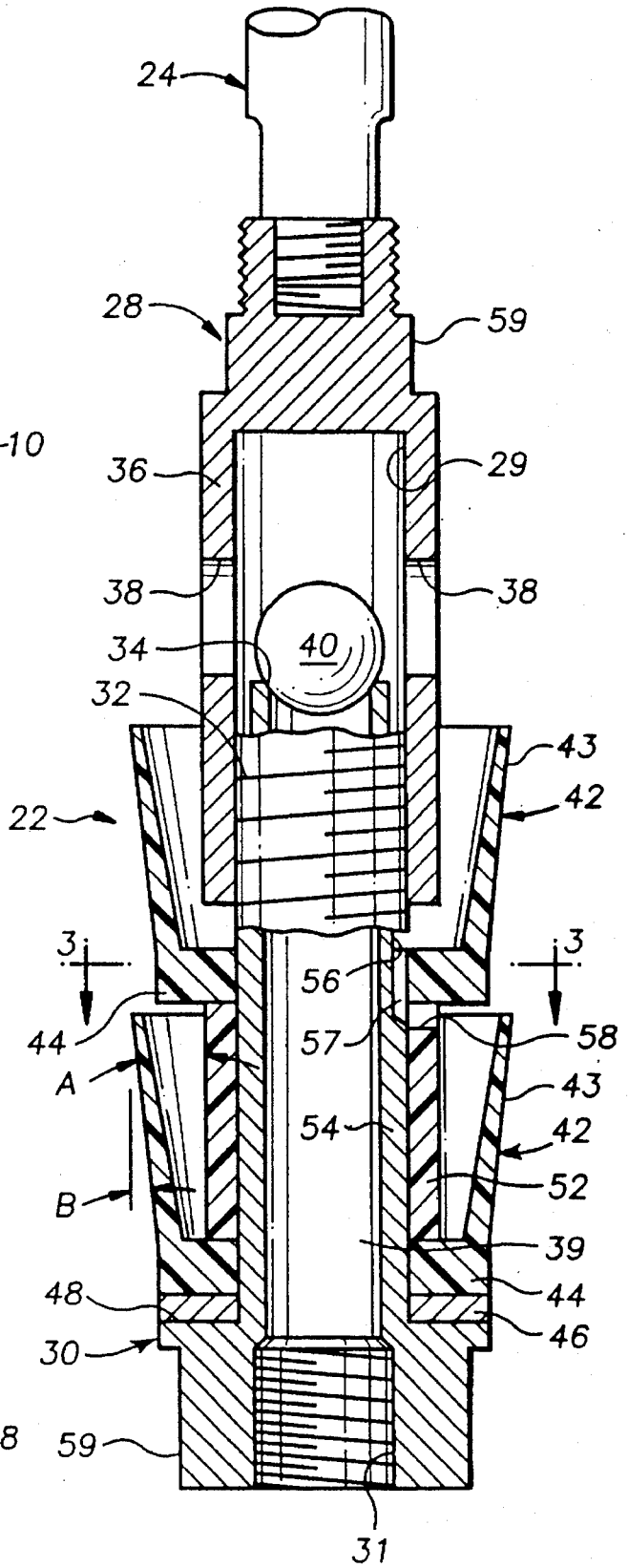
FIG. 2 is a vertical cross sectional view of the plunger assembly.

The plunger assembly 22 comprises an elongated cage and traveling valve assembly upper portion 28 having a downwardly open socket 29 and a lower or base end portion 30 centrally through bored and threaded at its depending end portion, as at 31, threadedly connected with the top portion 28 by threads 32. The inner periphery of the top end of the lower member 30 forms an annular valve seat 34. Above the seat 34 the wall 36 of the top portion 28 is provided with oppositely disposed ports 38, only two being shown (FIG. 2), which forms the upper end of a longitudinal fluid passageway 39 through the plunger. Prior to assembly of the top portion with the bottom portion, a ball valve 40 is placed within the top portion of the socket 29.

A pair of outwardly diverging wall synthetic material plunger cups 42 surround the lower plunger portion in superposed relation below the depending limit of the top portion wall 36. Each of the cups 42 have a wall 43 and a thickened centrally apertured base portion 44 which snugly contacts an intermediate peripheral portion of the plunger perimeter with the lowermost cup supported on a washer 46 overlying an upwardly facing shoulder 48. Each cup wall 43 is flared outwardly and upwardly and the thickness of each wall converges upwardly. Each cup inner peripheral wall surface is preferably disposed at an angle A (FIG. 2) for example 8°, with respect to the vertical. Similarly, the outer surface of the wall 43 is disposed on an angle B, for example 4° with respect to the vertical. The purpose of the upwardly converging wall feature of the respective cup 42 is to insure that fluid static head will bias the upper limit of the respective cup wall against the inner periphery of the cylinder 10.

Figure 3:
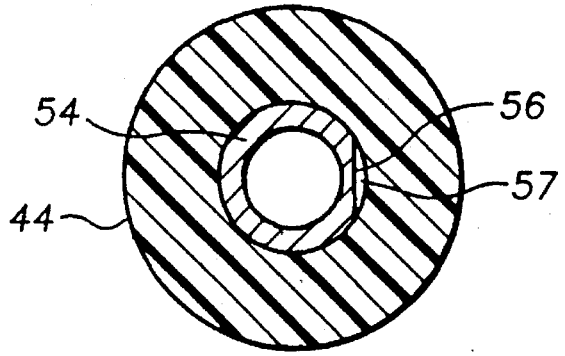
FIG. 3 is a horizontal sectional view taken substantially along the line 3—3 of FIG. 2.
Figure 4:
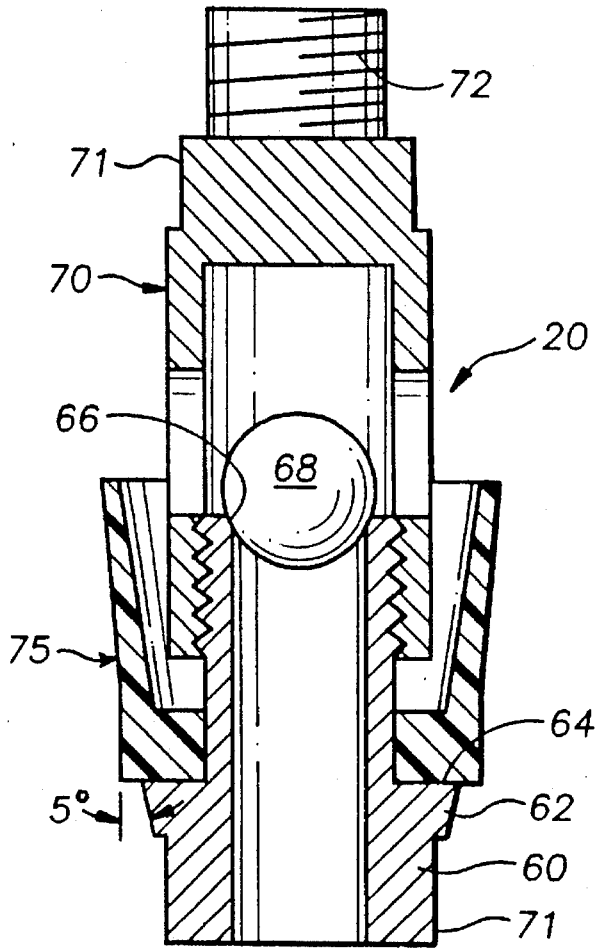
FIG. 4 is a vertical cross sectional view of the standing valve.
Figure 5:
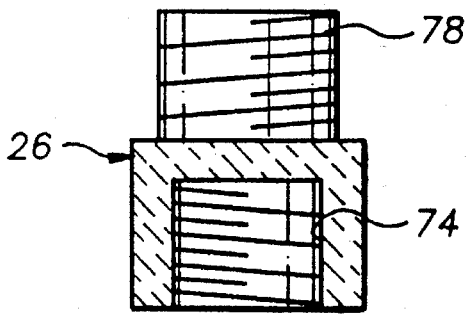
FIG. 5 is a vertical cross section of the frangible coupler.

A cylindrical spacer or sleeve 52 is interposed between the two cups to support the top cup above the lower cup. Water filling both cups insures a positive seal with the inner periphery of the cylinder 10 when the plunger is moved in an upward direction by the sucker rod string 24. To insure that the lower cup fills with water, a planar surface 56 (FIG. 3) subtends an arc of the periphery of the plunger wall 54 and extends vertically across the thickened base 44 of the upper cup 42 to form a fluid passageway 57 for water passage from the upper cup to the interior of the lower cup. Filling the lower cup is assured by forming a notch or recess 58 in the upper edge of the sleeve wall. Obviously, V-shaped slots, not shown, vertically formed in the plunger wall 54 across the thickened base 44 of the upper cup, would accomplish the same purpose. Wrench flats 59 are preferably formed on respective end portions of the plunger assembly 22.

The standing valve assembly 20 comprises a tubular body 60 and a valve and cage 70. The outer periphery of the body 60 depending end portion 62 converges downwardly from a shoulder 64, as for example on an angle of 5° with respect to the vertical, for entering and seating on the annular shoulder 18 of the coupling 16 (FIG. 1). The inner periphery of the upper end of the tubular body 60 forms an annular valve seat 66 for seating and sealing with the cage 70 ball valve 68. The valve cage assembly 70 is substantially identical with the plunger valve cage assembly 28, and is similarly threadedly connected with the periphery of the upper end portion of the standing valve body 60. Similarly, wrench flats 71 are formed on respective end portions of the standing valve assembly 20. A cup 75, substantially identical with the plunger cups 42, surrounds the body 60 and is supported by the body shoulder 64.

The upstanding threaded pin 72 of the valve cage means 70 threadedly receives the box 74 of the biodegradable frangible coupler member 26 having an upstanding threaded pin 78 threadedly received by the plunger 31 threads for connecting the plunger assembly 22 with the standing valve assembly 20 when lowering the two, as a unit, into the cylinder 10.

OPERATION

Assuming the plunger assembly 22 connected with the standing valve 20 by the coupler 74 is in the position illustrated by FIG. 1, an operator using a hammer or sledge, not shown, axially sharply strikes the upper end of the sucker rods 24. This forces the plunger assembly downward relative to the standing valve 20 and ruptures the frangible biodegradable material coupler 74, thus separating the plunger assembly 22 from the standing valve and simultaneously seating the standing valve on the annular shoulder 18. This permits vertical reciprocation of the sucker rod and plunger assembly relative to the cylinder 10 by mechanism, not shown, at the surface of the earth. The pumping operation then progresses in the manner briefly described hereinabove.

Briefly stated water, not shown, is forced to the surface of the earth through the tubing by upward movement of the plunger assembly 22 in which static head biases the cup walls 43 outwardly to lift the water within the cylinder while simultaneously filling the cylinder between the standing valve and the plunger by reducing pressure therein which lifts the valve 68 and draws water into the cylinder. Conversely downward movement of the plunger assembly into the filled depending end portion of the cylinder 10, forces the plunger valve 40 off its seat and water flows through the plunger passageway 39 to complete one cycle of operation of the plunger and standing valve.

Over time, the flexible walls 43 of the cups 42 gradually wear away to such an extent that the pumping operation necessitates the replacement of the cups which are pulled with the plunger to the surface of the earth by the sucker rods and replaced. In the event it becomes necessary to replace the standing valve assembly 20, the depending end of the plunger assembly 22 is lowered until the plunger threads 31 contact the threaded pin 72 of the standing valve cage assembly 70. Angularly rotating the sucker rods and plunger assembly 22, to the right in a thread tightening action, engages the plunger assembly threads 31 with the threads of the standing valve pin 70 for unseating the standing valve and moving it with the plunger to the surface of the earth.

Obviously the invention is susceptible to changes or alterations without defeating its practicability. Therefore, I do not wish to be confined to the preferred embodiment shown in the drawings and described herein.

I claim:

1. In a water well having a working cylinder at the depending end of a tubular pump string extending from the earth's surface into a wellbore containing water and having a reciprocable sucker rod string in and substantially coextensive with the tubing string, the improvement comprising:

pump plunger means including a tubular plunger body having a wall connected with a travelling valve cage within the cylinder and depending from said sucker rod string for reciprocation therewith;

a planar surface on the body wall subtending an arc of the periphery of said body intermediate its ends;

a pair of plunger cups, each cup of said pair of cups having an apertured base, surrounding an intermediate portion of said body in superposed relation; and, sleeve means within the lowermost cup of said pair of cups for supporting the base of the uppermost cup above the upper limit of the lowermost cup and in intersecting relation with respect to said planar surface for forming a vertical fluid passageway across the base of the upper cup of said pair of cups, whereby upward movement of said plunger body closes said travelling valve and fills both cups of said pair of cups with water and lifts the water above the cups and plunger means toward the surface of the earth.

2. The combination according to claim 1 in which said sleeve means includes:

a sleeve having a wall recess communicating with the fluid passageway and the interior of the lowermost cup of said pair of cups.

3. The combination according to claim 1 and further including:

standing valve assembly means a tubular standing valve body axially connected with a valve and cage and releasably seated within the depending end portion of the cylinder for admitting and maintaining water in the depending end portion of the cylinder; and, an upwardly open cup seal surrounding and secured to the standing valve body intermediate its ends for maintaining said standing valve seated by fluid static head.

4. The combination according to claim 2 and further including:

frangible coupler means connecting said plunger means with said standing valve assembly means for separating said plunger means from said standing valve means in response to sudden downward movement of said plunger means relative to said standing valve means.

5. In a water well having a working cylinder at the depending end of a tubular pump string extending from the earth's surface into a wellbore containing water and having a reciprocable sucker rod string in and substantially coextensive with the tubing string, the improvement comprising:

pump plunger means depending from said sucker rod string within the cylinder including a tubular plunger body having a wall connected at its upper limit with a valve and cage closing and opening the tubular body during respective upward and downward reciprocating movement with said sucker rod string;

a planar surface on the body wall subtending an arc of the periphery of said body intermediate its ends;

a pair of plunger cups, each cup of said pair of cups having an apertured base, surrounding an intermediate portion of said body in superposed relation; and, sleeve means within the lowermost cup of said pair of cups for supporting the base of the uppermost cup above the lowermost cup and in intersecting relation with respect to said planar surface for forming a vertical fluid passageway through the base of the upper cup for filling the lowermost cup of said pair of cups, whereby upward movement of said plunger body fills both cups of said pair of cups lifts water above the cups toward the surface of the earth.

6. The combination according to claim 5 in which said sleeve means includes:

a sleeve having a wall recess communicating with the fluid passageway and the interior of the lowermost cup of said pair of cups.

7. The combination according to claim 5 and further including:

standing valve assembly means including a tubular body axially connected with a valve and cage and releasably seated within the depending end portion of the cylinder for admitting and maintaining water in the depending end portion of the cylinder; and, an upwardly open cup seal surrounding and secured to the standing valve body intermediate its ends for maintaining said standing valve seated by fluid static head.

8. The combination according to claim 7 and further including:

frangible coupler means connecting said plunger means with said standing valve assembly means for separating said plunger means from said standing valve means in response to sudden downward movement of said plunger means relative to said standing valve assembly means.

* * * * *